US006281481B1

(12) United States Patent
Tiemann

(10) Patent No.: US 6,281,481 B1
(45) Date of Patent: Aug. 28, 2001

(54) GLASS-CERAMIC COOKTOP BURNER ASSEMBLY HAVING AN OPTICAL SENSOR

(75) Inventor: Jerome Johnson Tiemann, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/507,294

(22) Filed: Feb. 18, 2000

(51) Int. Cl.[7] ..... H05B 3/68
(52) U.S. Cl. ..... 219/446.1
(58) Field of Search ..... 219/502, 445.1, 219/446.1, 492, 497, 461; 126/390 G

(56) References Cited

U.S. PATENT DOCUMENTS

| | | | | |
|---|---|---|---|---|
| 4,237,368 | | 12/1980 | Welch . | |
| 4,740,664 | | 4/1988 | Payne et al. . | |
| 5,138,135 | * | 8/1992 | Husslein et al. | 219/464 |
| 5,378,874 | * | 1/1995 | Holling et al. | 219/506 |
| 5,448,036 | * | 9/1995 | Husslein et al. | 219/464 |
| 5,658,478 | * | 8/1997 | Roeschel et al. | 219/502 |
| 6,005,230 | * | 12/1999 | White, Jr. et al. | 219/492 |
| 6,039,040 | * | 3/2000 | Thumfort et al. | 126/39 G |
| 6,057,529 | * | 5/2000 | Kirby | 219/445.1 |
| 6,111,228 | * | 8/2000 | Berkcan et al. | 219/461 |
| 6,113,552 | * | 10/2000 | Saulnier et al. | 219/446.1 |
| 6,118,105 | * | 9/2000 | Berkcan et al. | 219/497 |
| 6,140,617 | * | 10/2000 | Berkcan et al. | 219/446.1 |

OTHER PUBLICATIONS

U.S. Patent Application Serial No. 09/372,468 (Atty. Docket No. RD–26460), filed Aug. 8, 1999.
U.S. Patent Application Serial No. 09/372,469 (Atty: Docket No. RD–26445), filed Aug. 8, 1999.

* cited by examiner

*Primary Examiner*—Teresa Walberg
*Assistant Examiner*—Leonid Fastovsky
(74) *Attorney, Agent, or Firm*—Pierce Atwood; Patrick R. Scanlon

(57) ABSTRACT

The field of view of an optical sensor used in a burner assembly of a glass-ceramic cooktop appliance is improved by providing the burner assembly with a wide angle optical element. The burner assembly includes a burner casing having a bore formed therein. The optical sensor is located in the lower end of the bore, and the wide angle optical element is located in the upper end of the bore. The wide angle optical element directs radiation from over the entire heated portion of the glass-ceramic plate onto the optical sensor. The a wide angle optical element also prevents dust from falling onto the sensor. In one preferred embodiment, the wide angle optical element is a Fresnel lens.

17 Claims, 1 Drawing Sheet

GLASS-CERAMIC COOKTOP BURNER ASSEMBLY HAVING AN OPTICAL SENSOR

BACKGROUND OF THE INVENTION

This invention relates generally to burner assemblies in glass-ceramic cooktop appliances and more particularly to optical sensors having an increased field of view for such burner assemblies.

The use of glass-ceramic plates as the cooking surface in cooking appliances such as cooktops and ranges is well known. Such cooking appliances (referred to herein as glass-ceramic cooktop appliances) typically include a number of heating elements or energy sources mounted under the glass-ceramic plate, one or more sensors for measuring the glass-ceramic temperature, and an electronic controller. The glass-ceramic plate presents a pleasing appearance and is easily cleaned in that its smooth, continuous surface lacks seams or recesses in which debris can accumulate. The glass-ceramic plate also prevents spillovers from falling onto the energy sources below. The controller controls the power applied to the energy sources in response to user input and input from the temperature sensors.

In one known type of glass-ceramic cooktop appliance, the glass-ceramic plate is heated by radiation from one or more of the energy sources disposed beneath the plate. The glass-ceramic plate is sufficiently heated by the energy source to heat utensils placed on it primarily by conduction from the heated glass-ceramic plate to the utensil. Another type of glass-ceramic cooktop appliance uses an energy source that radiates substantially in the infrared region in combination with a glass-ceramic plate that is substantially transparent to such radiation. In these appliances, a utensil placed on the cooking surface is heated partially by radiation transmitted directly from the energy source to the utensil, rather than by conduction from the glass-ceramic plate. Such radiant glass-ceramic cooktop appliances are more thermally efficient than other glass-ceramic cooktop appliances and have the further advantage of responding more quickly to changes in the power level applied to the energy source. Yet another type of glass-ceramic cooktop appliance inductively heats utensils placed on the cooking surface. In this case, the energy source is an RF generator that emits RF energy when activated. The utensil, which comprises an appropriate material, absorbs the RF energy and is thus heated.

In each type of glass-ceramic cooktop appliance, provision must be made to avoid overheating the glass-ceramic plate. For most glass-ceramic materials, the operating temperature should not exceed 600–700° C. for any prolonged period. Under normal operating conditions, the temperature of the glass-ceramic plate will generally remain below this limit. However, conditions can occur that can cause this temperature limit to be exceeded. Commonly occurring examples include operating the appliance with a small load or no load (i.e., no utensil) on the cooking surface, using badly warped utensils that make uneven contact with the cooking surface, and operating the appliance with a shiny and/or empty utensil.

To protect the glass-ceramic plate from extreme temperatures, glass-ceramic cooktop appliances ordinarily have some sort of temperature sensor for monitoring the temperature of the glass-ceramic plate. If the glass-ceramic plate approaches its maximum temperature, the power supplied to the energy source is reduced to prevent overheating. In addition to providing thermal protection, such temperature sensors can be used to provide temperature-based control of the cooking surface and to provide a hot surface indication, such as a warning light, after a burner has been turned off.

One known approach to sensing temperature in glass-ceramic cooktop appliances is to place a temperature sensor directly on the underside of the glass-ceramic plate. With this approach, however, the temperature sensor is subject to the high burner temperatures and is thus more susceptible to failure. Moreover, direct contact sensors are limited in the area of the glass-ceramic plate that they can monitor and can fail to detect hot spots that may form on the glass-ceramic plate. Thus, it is desirable to use an optical sensor that "looks" at the glass-ceramic plate from a remote location to detect its temperature.

For cost and mechanical reasons, it is advantageous to locate the optical temperature sensor concentric to and beneath the burner. In this location, however, the sensor will only sense a small region of the glass-ceramic plate that is directly above the center of the burner because of its relatively small field of view (typically about 80 degrees in conventional sensors). This means that a significant portion of the heated glass-ceramic would not be under the thermal protection afforded by the optical temperature sensing system. Furthermore, such optical sensors are susceptible to accumulations of dust that is released from the burner insulation during shipment or installation of the appliance. Such dust accumulations on the optical sensor can reduce its efficiency and accuracy.

Accordingly, it would be desirable to have an optical temperature sensor for glass-ceramic cooktop appliances that has a wide field of view and is less susceptible to dust accumulation than existing devices.

BRIEF SUMMARY OF THE INVENTION

The above-mentioned need is met by the present invention, which provides a burner assembly that includes a burner casing having a bore formed therein. A sensor is located in the lower end of the bore, and a wide angle optical element is located in the upper end of the bore. In one preferred embodiment, the wide angle optical element is a Fresnel lens.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
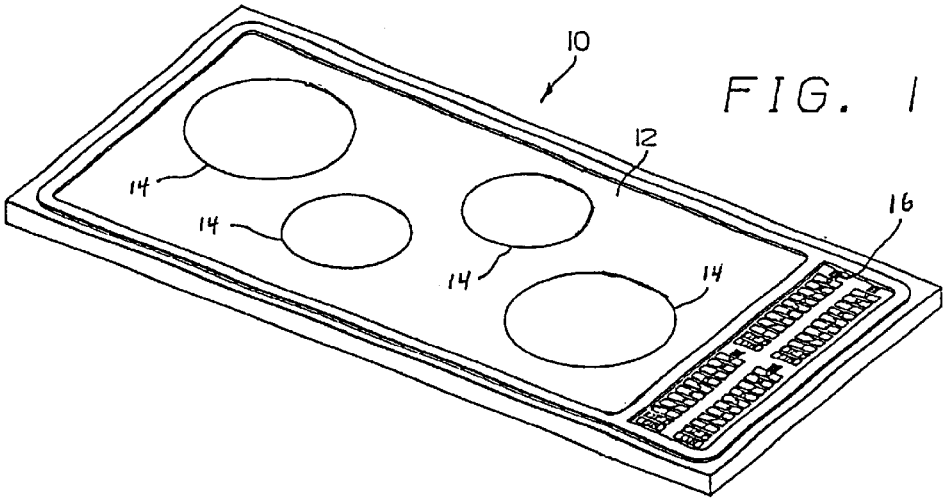
FIG. 1 is a perspective view of a glass-ceramic cooktop appliance incorporating a preferred embodiment of the present invention.

Referring to the drawings wherein identical reference numerals denote the same elements throughout the various views, FIG. 1 shows a glass-ceramic cooktop appliance 10 having a glass-ceramic plate 12 that provides a cooking surface. The appliance 10 can be any type of cooktop appliance including a range having an oven and a cooktop provided thereon or a built-in cooktop unit without an oven. Circular patterns 14 formed on the cooking surface of the plate 12 identify the positions of each of a number (typically, but not necessarily, four) of burner assemblies (not shown in FIG. 1) located directly underneath the plate 12. A control panel 16 is also provided. As is known in the field, the control panel 16 includes knobs, touch pads or the like that allow an operator of the appliance 10 to individually control the temperature of the burner assemblies.

Figure 2:
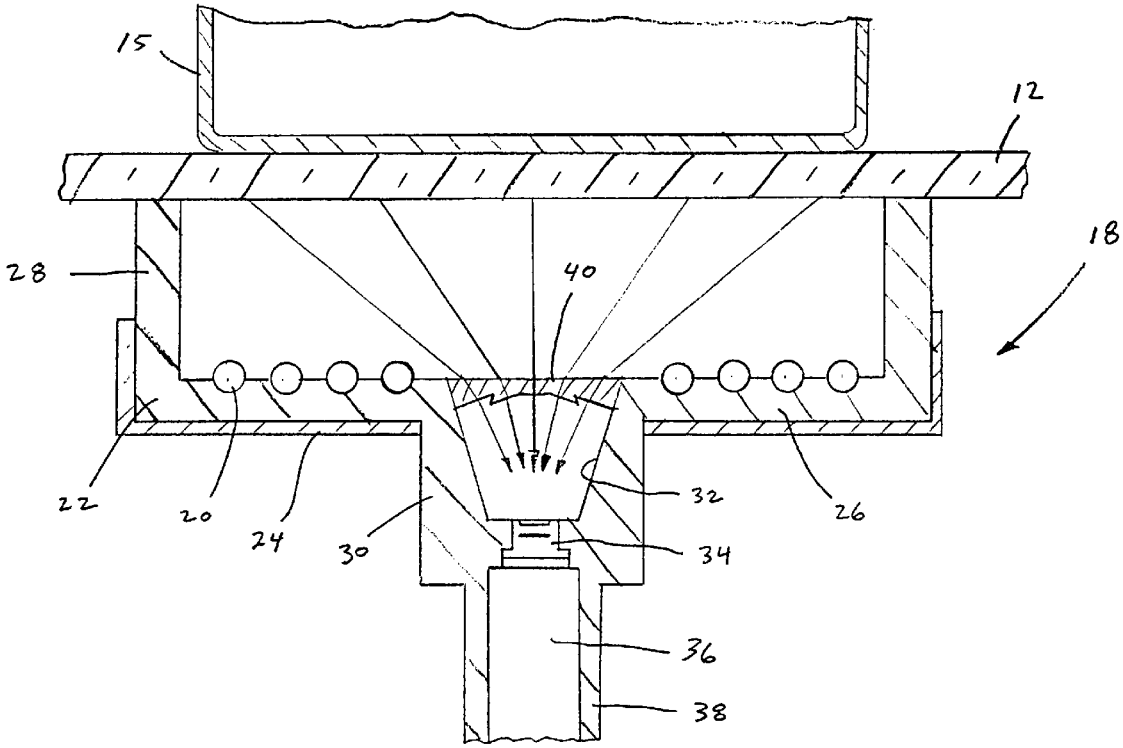
FIG. 2 is a cross-sectional view of one of the burner assemblies from the glass-ceramic cooktop appliance of FIG. 1.

Turning to FIG. 2, an exemplary one of the burner assemblies, designated generally at reference numeral 18, is shown located beneath the glass-ceramic plate 12 so as to heat a utensil 15 placed thereon. The burner assembly 18 includes a controllable energy source 20 in the form of an open coil electrical resistance element, which is designed when fully energized to radiate primarily in the infrared region of the electromagnetic energy spectrum. It should be noted that another type of energy source, such as an RF generator, could be used in place of the resistance element. The energy source 20 is arranged in an effective heating pattern such as a concentric coil and is secured to a burner casing 22 that is supported in a sheet metal support pan 24. The burner casing 22 is made from a thermally insulating material, such as ceramic.

The burner casing 22 includes a substantially circular base portion 26 to which the energy source is secured and an annular portion 28 that extends upwardly from the perimeter of the base portion 26. The annular portion 28 serves as an insulating spacer between the energy source 20 and the glass-ceramic plate 12. The support pan 24 is spring loaded upwardly, forcing the annular portion 28 into abutting engagement with the underside of the glass-ceramic plate 12, by conventional support means (not shown). The burner casing 22 further includes a substantially cylindrical hub 30 extending downwardly from the center of the base portion 26. The base portion 26, the annular portion 28 and the hub 30 can be integrally formed as a one-piece structure, or can be separate pieces joined together. A tapered bore 32 extends from the center of the base portion 26 into the hub 30 and thus faces the interior of the burner assembly 18. The bore 32 is tapered so as to have its largest diameter at its upper end, which is adjacent to the base portion 26, and its smallest diameter at its lower end, which is near the bottom of the hub 30.

An optical temperature sensor 34 is disposed in the lower end of the tapered bore 32 and is oriented so as to receive radiation from the heated portion of the glass-ceramic plate 12 (i.e., the portion directly above the burner assembly 18). The optical temperature sensor can be any suitable type of device such as thermopile, bolometer or the like. In response to the radiation from the glass-ceramic plate 12, the optical temperature sensor 34 generates a signal that corresponds to the temperature of the glass-ceramic plate 12. This signal is fed to a conventional controller (not shown), which is a common component used in most glass-ceramic cooktop appliances.

The temperature sensor 34 is disposed in contact with a heat sink 36, which is preferably a cylinder of a high thermally conductive material. The heat sink 36 is thus able to absorb heat from the temperature sensor 34 and dissipate it to another area of the appliance 10. Therefore, the heat sink 36 keeps the temperature sensor 34 from overheating. The heat sink 36 is enclosed by an insulating sleeve 38, which can be either an integral extension of the hub 30 (as shown in FIG. 2) or a separate piece in contact with the hub 30.

The burner assembly 18 includes a wide angle optical element 40 located in the upper end of the tapered bore 32 to increase the field of view of the optical temperature sensor 34. In one preferred embodiment, the wide angle optical element 40 is a Fresnel lens having facets formed on one side that direct radiation (represented by arrows in FIG. 2) from all over the heated portion of the glass-ceramic plate 12 onto the optical temperature sensor 34. In other words, the temperature sensor's field of view encompasses the entire heated portion of the glass-ceramic plate 12 because of the wide angle optical element 40.

The Fresnel lens 40 is preferably of a circular configuration having a diameter that is equal to the diameter of the bore 32 at its upper end. Thus, the Fresnel lens 40 fits snugly in the upper end of the tapered bore 32. Due to this tight fit, the Fresnel lens 40 will prevent any dust in the interior of the burner assembly 18 from entering the bore 32. The diameter of the bore 32 and the Fresnel lens 40 is considerably greater than the width of the temperature sensor 34, but is smaller than the innermost turn of the open coil energy source 20. Preferably, the Fresnel lens 40 is oriented with its facets on the underside, facing the optical temperature sensor 34. Thus, the Fresnel lens 40 has a smooth upper side that is situated in the plane of the base portion 26 of the burner casing 22; that is, the wide angle optical element 40 is coplanar with the base portion 26.

The distribution and angles of the lens facets can be designed to weight the importance of different radial locations on the heated portion of the glass-ceramic plate 12 according to any desired finction. In one preferred embodiment, the sampling of the heated portion of the glass-ceramic plate 12 is approximately circularly symmetric with increased coverage at the radial location where hot spots are known to occur. That is, the lens facet that receives radiation from a certain radial location on the heated portion of the glass-ceramic plate 12 known to develop hot spots would be configured larger so that more radiation from that radial location would impinge on the optical temperature sensor 34. This arrangement would insure that the optical temperature sensor 34 would detect hot spots in that radial location.

The wide angle optical element or Fresnel lens 40 can be made of any suitable material capable of transmitting the radiation from the glass-ceramic plate 12. The lens material should be selected based on its transmission in the infrared region, and to a lesser extent on its ability to be formed by a low cost process such as press molding. In order to be transparent in both the region where the glass-ceramic plate 12 transmits and the region where it absorbs, the transmission band of the Fresnel lens 40 should extend from about 1–2 microns on the short wavelength end to about 6–7 microns on the long wavelength end. The lens material should also be capable of withstanding the high temperatures of the burner assembly 18. Magnesium fluoride is one suitable material for the Fresnel lens 40.

In addition to increasing the field of view of the optical temperature sensor 34, the wide angle optical element 40 also serves to intercept any dust in the interior of the burner assembly 18. It is possible for dust particles to become dislodged from the burner casing 22 during shipping or installation of the appliance 10. As mentioned above, if such dust is allowed to accumulate on the optical temperature sensor 34, it would impair the sensor's ability to accurately detect the glass-ceramic temperature. By intercepting the dust, the wide angle optical element 40 prevents it from landing on the optical temperature sensor 34. And since the diameter of the wide angle optical element 40 is much greater than the diameter of the sensor window, this dust will occupy smaller fraction of the optical aperture than it would have if it had collected on the sensor window. Thus, with the wide angle optical element 40, dust is no longer a serious issue.

The foregoing has described a burner assembly having an optical temperature sensor that has a wide field of view and is less susceptible to dust accumulation. Although the foregoing has described an optical sensor for detecting the temperature of the glass-ceramic cooktop surface, it should be understood that the wide angle field of view of the present invention could also be applicable to other sensing applications. This would include optical sensors that are designed to "look" through the glass-ceramic plate to detect characteristics of a utensil placed on the cooktop, such as the temperature, size or type of the utensil, the presence or absence of the utensil, or the properties, such as boiling state, of the utensil contents.

While specific embodiments of the present invention have been described, it will be apparent to those skilled in the art that various modifications thereto can be made without departing from the spirit and scope of the invention as defined in the appended claims.

What is claimed is:

1. A burner assembly for a cooktop appliance, said burner assembly comprising:

a burner casing having a bore formed therein, said bore having an upper end and a lower end;

a sensor located in said lower end of said bore; and a wide angle optical element located in said upper end of said bore.

2. The burner assembly of claim 1 wherein said wide angle optical element is a Fresnel lens.

3. The burner assembly of claim 2 wherein said Fresnel lens is circular and has a diameter that is equal to the diameter of said upper end of said bore.

4. The burner assembly of claim 2 wherein said Fresnel lens has facets formed on one side thereof.

5. The burner assembly of claim 1 wherein said burner casing comprises a base portion and a hub extending downwardly from said base portion, said bore being formed in said hub.

6. The burner assembly of claim 5 wherein said wide angle optical element is coplanar with said base portion.

7. The burner assembly of claim 1 wherein said bore is tapered so that said upper end is larger than said lower end.

8. The burner assembly of claim 1 further comprising an energy source secured to said burner casing.

9. The burner assembly of claim 1 wherein said sensor is an optical temperature sensor.

10. A burner assembly for a cooktop appliance having a glass-ceramic cooking surface, said burner assembly comprising:

a burner casing located under said glass-ceramic cooking surface and having a bore formed therein, said bore having an upper end and a lower end;

an energy source secured to said burner casing;

a sensor located in said lower end of said bore so as to receive radiation from said glass-ceramic cooking surface; and a Fresnel lens located in said upper end of said bore.

11. The burner assembly of claim 10 wherein said Fresnel lens is circular and has a diameter that is equal to the diameter of said upper end of said bore.

12. The burner assembly of claim 10 wherein said Fresnel lens has a plurality of facets formed on one side thereof.

13. The burner assembly of claim 12 wherein one of said plurality of facets that corresponds to a location of said glass-ceramic cooking surface that is known to develop hot spots is larger than other ones of said plurality of facets.

14. The burner assembly of claim 10 wherein said burner casing comprises a base portion and a hub extending downwardly from said base portion, said bore being formed in said hub.

15. The burner assembly of claim 14 wherein said Fresnel lens is coplanar with said base portion.

16. The burner assembly of claim 10 wherein said bore is tapered so that said upper end is larger than said lower end.

17. The burner assembly of claim 10 wherein said sensor is an optical temperature sensor.

* * * * *